United States Patent [19]

Scott et al.

[11] 4,134,534

[45] Jan. 16, 1979

[54] CARTON WITH INTEGRAL CARRYING HANDLE

[75] Inventors: Raymond G. Scott, Oak Brook; Lawrence S. Wysocki, Chicago, both of Ill.

[73] Assignee: Champion International Corporation, Stamford, Conn.

[21] Appl. No.: 877,224

[22] Filed: Feb. 13, 1978

[51] Int. Cl.[2] ..... B65D 5/46

[52] U.S. Cl. ..... 229/52 B

[58] Field of Search ..... 229/52 A, 52 B

[56] References Cited

U.S. PATENT DOCUMENTS

| | | | |
|---|---|---|---|
| 2,693,310 | 11/1954 | Stopper | 229/52 B |
| 2,942,771 | 6/1960 | Spigelman | 229/52 A |
| 3,790,066 | 2/1974 | Malinowski | 229/52 B |
| 3,801,012 | 4/1974 | Thelen | 229/52 A |

FOREIGN PATENT DOCUMENTS

| | | | |
|---|---|---|---|
| 2413819 | 10/1974 | Fed. Rep. of Germany | 229/52 B |
| 2459705 | 7/1976 | Fed. Rep. of Germany | 229/52 B |
| 1355441 | 6/1974 | United Kingdom | 229/52 B |

*Primary Examiner*—Davis T. Moorhead
*Attorney, Agent, or Firm*—Evelyn M. Sommer

[57] ABSTRACT

A carton provided with an integral, pivotable carrying handle on the top wall. The handle is die-cut in a blank of paperboard stock used to form the carton. When the carton is erected, the handle can be pivoted from a substantially flat stored position on the top wall to an upright use position for carrying the carton.

6 Claims, 12 Drawing Figures

CARTON WITH INTEGRAL CARRYING HANDLE

BACKGROUND OF THE INVENTION

1. Field of the Invention

This invention relates to a carton construction, and more particularly, a carton construction provided with an integral handle on the top thereof for carrying the carton and its contents.

2. Description of the Prior Art

Heretofore, it was common practice to affix a separate combination paper and plastic handle to the top of a carton construction, e.g., a large carton filled with laundry detergent, so the carton and its contents could be conveniently carried out of a retail establishment by a purchaser.

Due to the slow speed of applying the combination paper and plastic handle to the carton during fabrication, cost of construction has become excessive. Users, therefore, have created a demand for a less costly handle system, which is required on such cartons because of its bulk and weight.

Accordingly, this invention provides a handle integrally affixed to the carton blank in such a manner so that it can be formed expediently along with the erection of the carton blank. The handle is also provided with a reinforcement to prevent tearing and rupture at its joinder to the carton. Since the handle is integrally formed with the carton blank, it is also conveniently available for use by the carton consumer, who need only bend it out of the plane of the top of the carton to a substantially uptight condition ready for use.

SUMMARY OF THE INVENTION

In accordance with the invention, a paperboard blank is provided having front, back and side panels which are connected by and folded about vertical score lines to form a rectangular parallelopiped enclosure or carton. Each of the front, back, and side panels include upwardly and downwardly extending substantially rectangular flaps connected to the panels by horizontal score lines. When the flaps are folded, a bottom and top wall for the enclosure is provided.

Die cut in the upwardly extending flaps connected to the front and back panels, respectively, are mating handle elements, which when glued form an an integral handle with the top wall of the carton which can be pivoted from a stored or non-use position lying substantially flat on the carton top wall to a substantially upright position perpendicular thereto.

Each handle element is die-cut from the top edge of the upwardly extending flap along diverging lines towards the front and back wall portions of the front and back panels, respectively, of the blank. Then, the handle element is scored substantially parallel to the top edge of its respective front and back flap to form a hinge therefor. A rectangular portion is die-cut from the interior of each handle element, but the lowermost edge thereof is left intact with the remainder of the flap adjacent the score line.

During assembly, the upwardly extending flaps connected to the front and back panels are folded into overlapping condition. One of the handle elements on either the front or back flaps is bent back upon itself 180° about its joining score lines to present a complementary surface facing the other handle element. The facing surfaces, as well as the overlapping flaps including the rectangular die-cut portion, can then be glued together.

The secured handle elements will lie substantially flat on the top wall of the carton, but can be pivoted about the score lines to a substantially upright condition.

In order to reinforce the joinder of the handle to the top wall of the carton, a pressure sensitive type tape is applied in a continuous strip across the entire width of the carton so as to lie just below and parallel to the joinder score line hinges of each handle element. This aids in precluding the handle from tearing or rupturing from the carton when the weight of the carton and its contents are supported by the handle.

Additionally, the rectangular die-cut portion of one of the handle elements can be slit parallel to the top edge of the flap from which it is cut. In this embodiment the top edge of the die-cut portion is hingedly joined by a score line to the lower edge of the central portion of the handle element. When the handle elements are glued together, as mentioned heretofore, the additional tab formed by the remaining portion of the rectangular die-cut portion hingedly connected to one of the handle elements may be rotated and bent 180° around the lower edges of the joined handle elements to prevent cutting of the fingers when carrying the carton.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
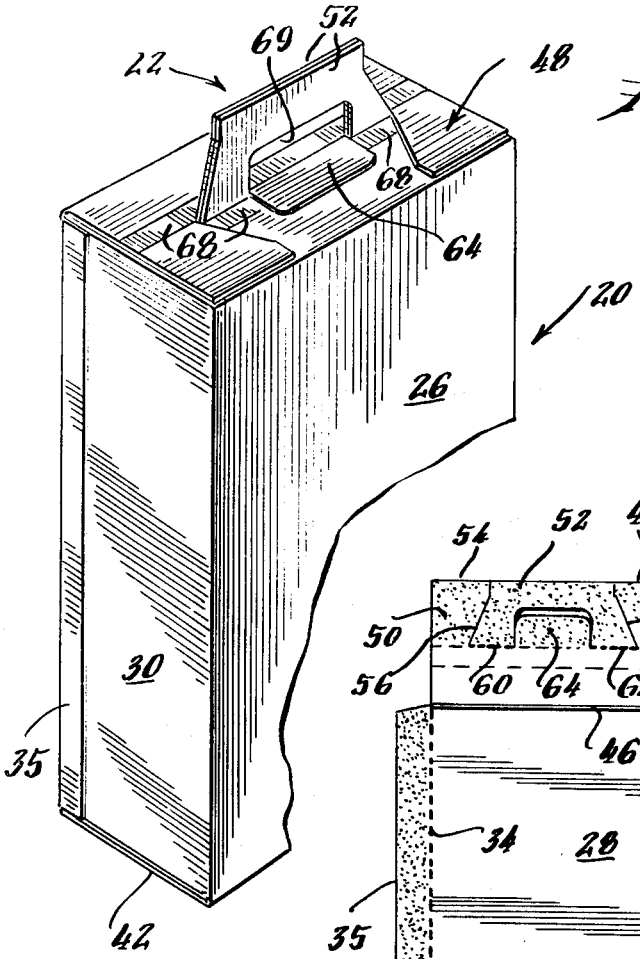
FIG. 1 is a framentary perspective view of a carton provided with the integral carrying handle of the present invention.
Figure 2:
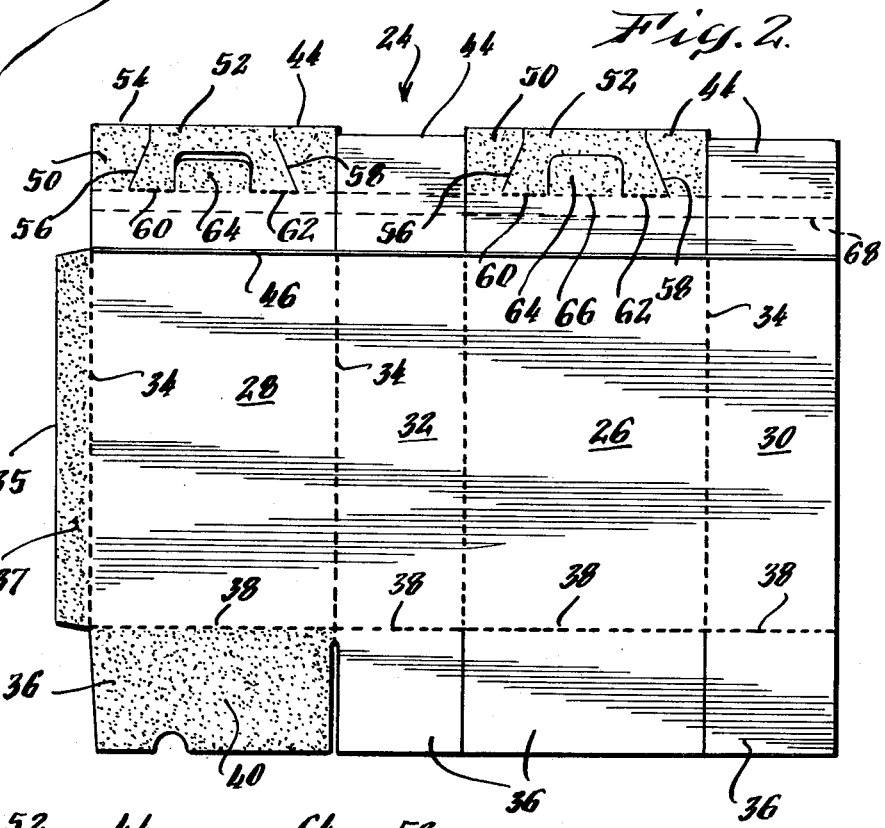
FIG. 2 is a plan view of a blank for forming the carton of FIG. 1.
Figure 3:
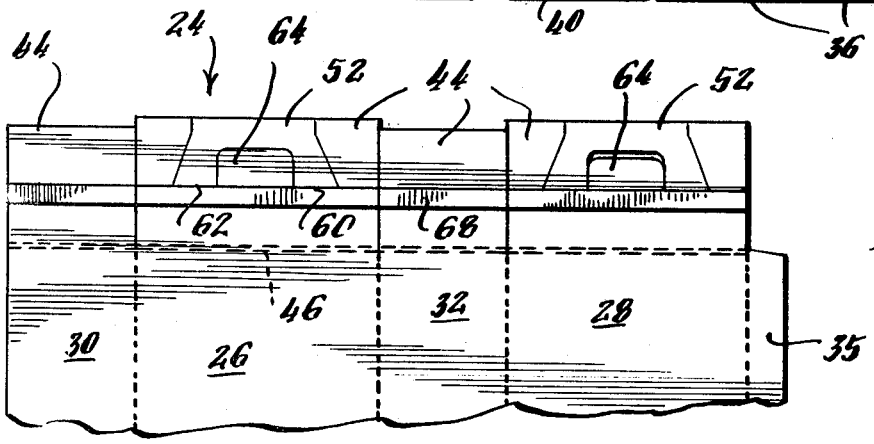
FIG. 3 is a plan view of the top portion of the opposite side of the blank of FIG. 2.

Referring now to the drawings in detail, wherein like numerals indicate like elements throughout the several views, a carton 20 having an integral carrying handle 22 is formed from a paperboard blank 24 having a front panel 26, a back panel 28, and a pair of side panels 30 and 32, which are connected by and folded about vertical score lines 34 to form a substantially rectangular parallelopiped enclosure.

Connected by a vertical score line 34 to the free edge of back panel 28 is an extension flap 35, provided with an adhesive surface 37. Flap 35 is bent about the free edge of side panel 30 and adhered thereto to maintain the rectangular configuration of carton 10. Alternatively, the opposite surface of flap 35 can be provided with adhesive and the flap connected to the interior surface of said panel 30.

Each of the front, back, and side panels includes a downwardly extending, subtantially rectangular flap 36 connected to its respective panel by a horizontal score line 38. The flap 36 connected to back panel 28 has an adhesive surface 40. When flaps 36 are folded about score lines 38, the flaps connected to the front and back panels overlap the flaps connected to the side panels and each other to form a bottom wall 42 for carton 20. The surface 40 can be adhesively connected to the lower surface of the flap 36 connected to the front wall 26 to retain the bottom wall together.

Each of the front, back and side panels also includes an upwardly extending, substantially rectangular flap 44 connected to its respective panel by a horizontal, reinforced rib 46 extending the entire width of blank 24. Rib 46 serves as a reinforced hinge about which each of the flaps 44 can be bent and overlapped to form the top wall 48 of carton 20. When bent, one of the flaps 44 connected to the back or front panel completely overlies the flaps 44 connected to the side panels (as shown in FIGS. 4 to 7), while the other of the flaps 44 connected to the back or front panel overlaps the one flap 44 overlying the flaps connected to the side panels. To retain the flaps closed on the carton 20, each of the flaps 44 connected to the front and back panels has an adhesive surface 50; the adhesive surface on the one back or front flap 44 being secured to the top surface of the side flaps 44, while the other back or front flap 44 being secured to the top surface of the one back or front flap.

Figure 6:
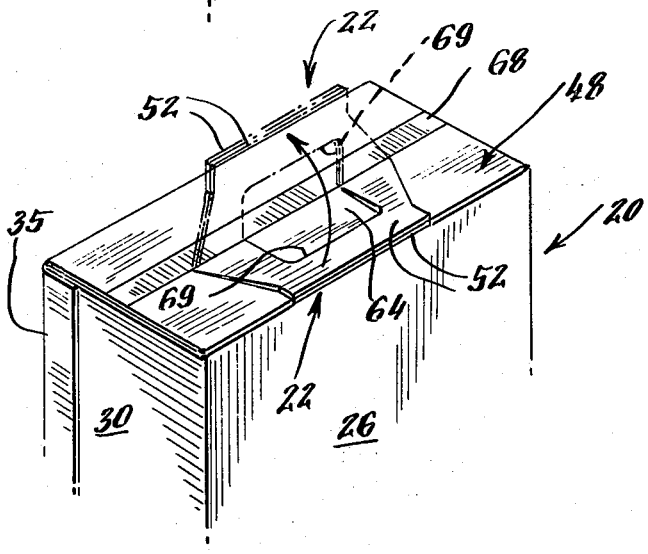
Figure 7:
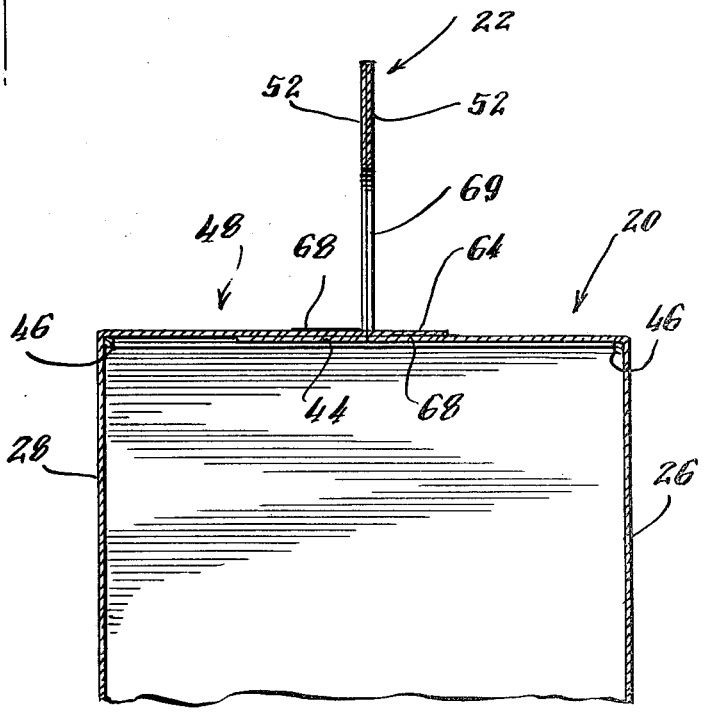
FIG. 7 is a longitudinal cross-sectional view of the carton of FIG. 1.
Figure 8:
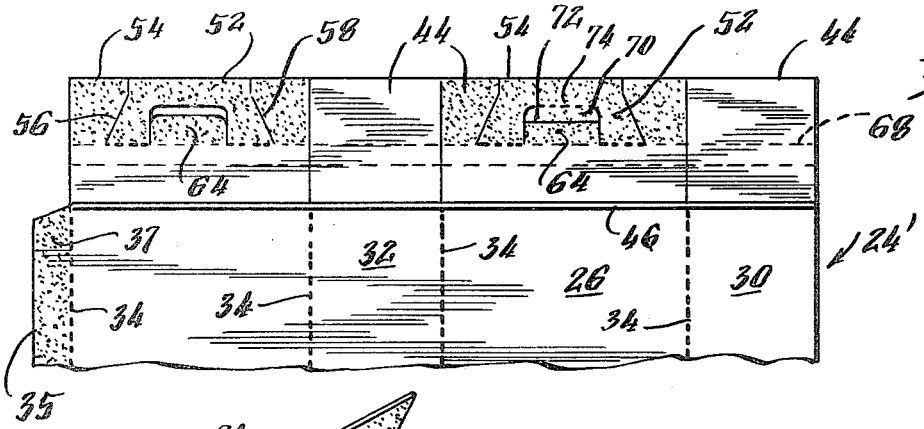
FIG. 8 is a plan view of an alternate embodiment of the blank for forming a carton provided with an integral carrying handle having a finger guard tab.
Figure 9:
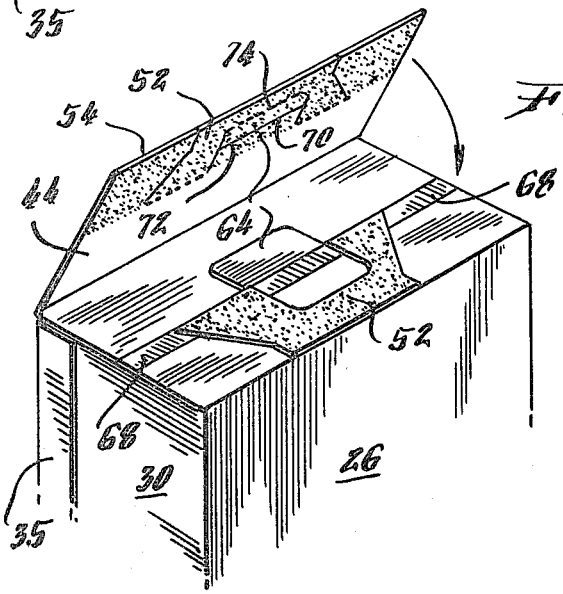
FIGS 9 to 11 are perspective views illustrating the manner in which a carton is constructed from the blank of FIG. 8.

Die-cut in the upwardly extending flaps 44 connected to the back and front panels 28 and 26, respectively, are mating handle elements 52, which when glued together, form the integral handle 22 for carton 20, which can be pivoted from a stored or non-use position lying substantially flat on the carton top wall 48, as shown in FIG. 6, to a substantially upright position perpendicular thereto, as shown in FIGS. 1 and 7.

Each handle element 52 is die-cut from the top edge 54 of the upwardly extending flap 44 along spaced diverging lines 56 and 58 towards the front and back wall portions of the front and back panels 26 and 28, respectively, of the blank 24. Then, the handle element is scored substantially parallel to the top edge of its respective front and back flap at 60 and 62, to form a hinge therefor. A rectangular portion 64 is die-cut from the interior of each handle element, but the lowermost edge 66 thereof is left intact with the remainder of the flap 44 adjacent to and contiguous with the score lines 60 and 62.

Figure 4:
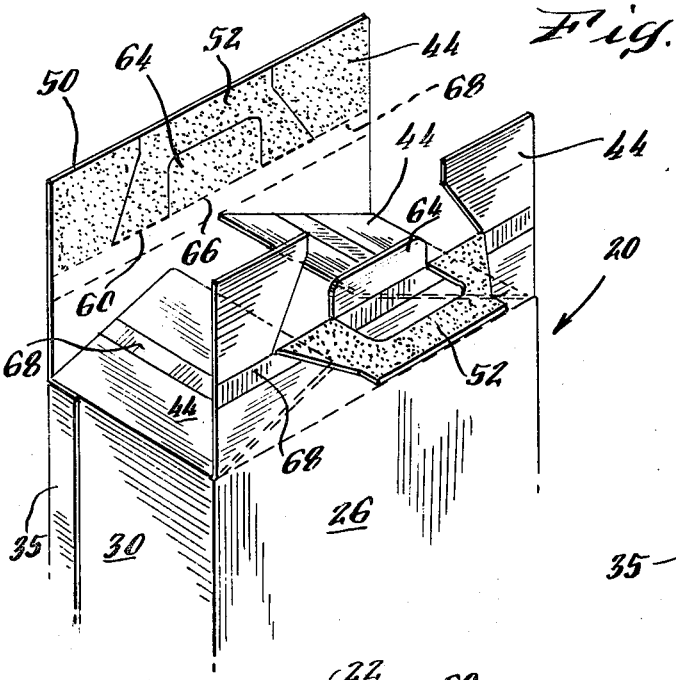
FIGS. 4 to 6 are perspective views illustrating the manner of forming the carton of FIG. 1 from the blank of FIG. 2.
Figure 5:
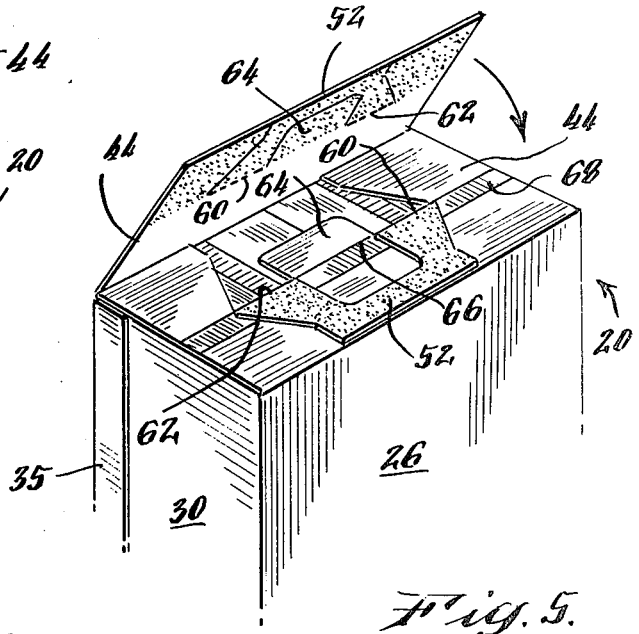

As shown in FIGS. 4 to 6, inclusive, during assembly, the upwardly extending flaps 44 connected to the front and back panels are folded into overlapping condition. One of the handle elements 52 on either the front or back flaps 44 is bent back upon itself 180° about its joining score lines 60 and 62 to present a complementary surface facing the other handle element 52 (FIG. 5). The facing adhesive surfaces 50, as well as the remainder of the overlapping flaps 44 including the rectangular die-cut portion 62, can then be glued together.

The secured handle elements 52 will lie substantially flat on the top wall of the carton, as shown in FIG. 6, but can be pivoted together about their score lines 60 and 62 to a substantially upright condition, as shown by the phantom lines in FIG. 6, providing an aperture 69 to receive the fingers of a hand. The aperture 69 is formed by the non-pivotable portions 64 of each handle element being held rigidly adhered to the top wall 48 of carton 20.

In order to reinforce the joinder of the handle 22 to the top wall 48 of the carton 20, a pressure sensitive type tape 68 is applied in a continuous strip across the entire width of the carton 20 on the outer surface of blank 24 before the flaps are cut, so as to lie just below and parallel to the joinder score line hinges 60 and 62 of each handle element 52. This aids in precluding the handle from tearing or rupturing from the carton when the weight of the carton and its contents are supported by the composite, integral handle 22. Alternatively, tape 68 may be applied across the entire width of the inner surface of blank 24 below and parallel to hinges 60 and 62 or if the paperboard of the blank is of a two-ply construction, the tape may be sandwiched between the plies adjacent hinge 60 and 62. The tape may have a mesh construction, if desired, and may in the laminated version be disposed along the entire length and width of the panels 44.

In lieu of a pressure sensitive or mesh tape, the reinforcement may be supplied by utilizing specially designed embossings or debossings on the blank which surround the handle structure. By incorporating such embossments or debossments, not only can reinforcement of the handle be achieved, but end panel dimensional disparity of the entire end flap configuration is reduced when the flaps are folded into their final configuration. Additionally, the embossing and debossing allows the end flaps to interlock thereby providing more positive glue adhesion and more resistance to breakage where the carton is subjected to dropping and lifting.

Figure 10:
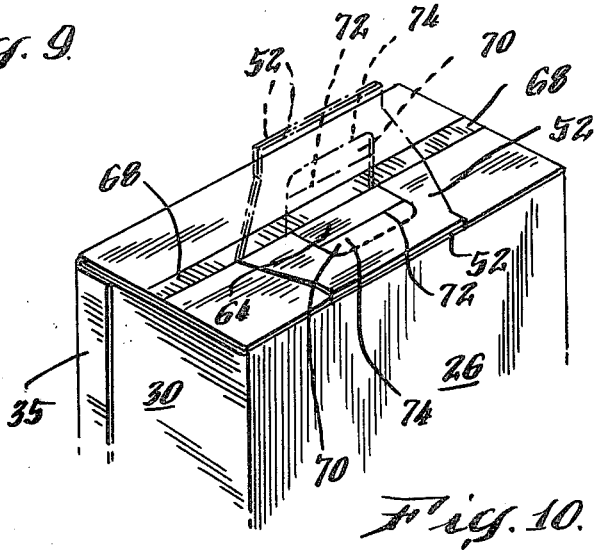
Figure 11:
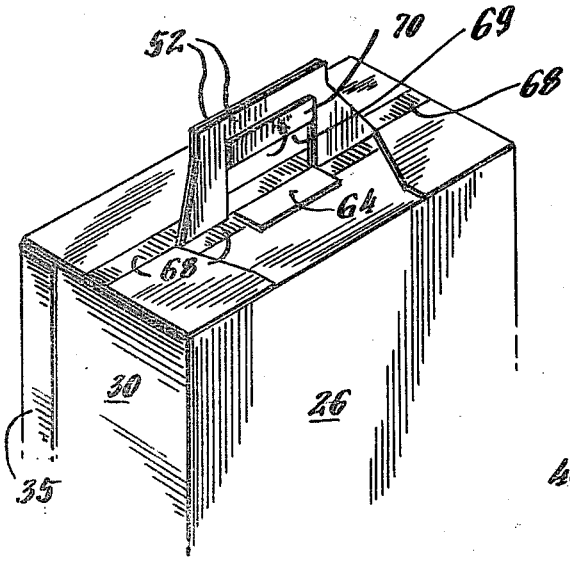
Figure 12:
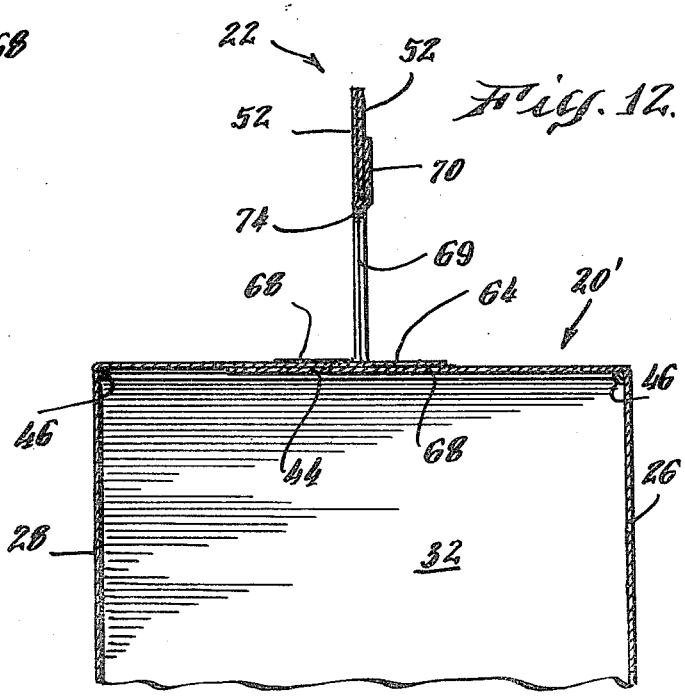
FIG. 12 is a longitudinal cross-sectional view of the carton of FIG. 11.

With reference to the modified blank 24' illustrated in FIGS. 8 to 11, inclusive, to form carton 20' of FIG. 12, the identical elements corresponding to those found in blank 24 are indicated by similar numerals. The blank 24' and carton 20' differs from blank 24 and carton 20 in the provision of a finger guard tab 70 on the integral carrying handle 22 to prevent cuttng of the fingers of a carrier inserted against the sharp edges of the aperture in the handle 22 formed by the removal of portions 64 therefrom.

In blank 24', the rectangular die-cut portion 64 of one of the handle elements 52 is slit at 72 parallel to the top edge 54 of the flap 44 from which it is cut to form the finger guard tab 70. The top edge of tab 70 of the die-cut portion 64 is hingedly joined by a score line 74 to the lower edge of the central portion of the handle element 52. When the handle elements are glued together, as shown in FIGS. 10 and 11, the additional tab 70 formed by the remaining portion of the rectangular die-cut portion 62 hingedly connected at 74 to one of the handle elements 52 may be rotated about score line 74 and bent 180° around the lower edges of the joined handle elements 52, as shown in FIGS. 11 and 12, to prevent cutting of the fingers when carrying the carton 20'.

What is claimed as new is:

1. A carton comprising:

opposed front and back walls joined by opposed side walls;

a bottom and top wall between said front and back walls, said top wall including at least two overlapping flaps, one of said flaps being hingedly connected to said front wall and the other of said flaps being hingedly connected to said back wall;

a handle element cut in each of said flaps, each of said handle elements including:

outer edges formed by spaced lines cut in each of said flaps extending inwardly from a top edge thereof;

a score line hinge extending towards each other from an end of each of said outer edges generally parallel to the top edge of the flap;

a central portion cut from the flap between said score line hinges, defining a lower edge on said handle element generally parallel to the top edge of said flap, said central portion of each of said handle elements being substantially rectangular in plan and cut along three edges, the intact edge of said central portion being between said score line hinges, said central portion of each handle element being overlapped and secured together, said central portion of each of said handle elements including:

a first tab substantially rectangular in plan and cut along three edges, the intact edge of said first tab being between said score line hinges, a second tab substantially rectangular in plan and cut along three edges, the intact edge of said second tab being hingedly connected to the lower edge of said handle element, such that upon securing said handle elements, together said second tab can be bent about its intact edge and the lower edge of the other handle element;

said carton further comprising:

a strip of reinforcing tape adhered to each of said flaps parallel to and just below the score line hinges of each handle element, said tape extending across the entire width of said flaps;

whereby one of said handle elements can be bent substantially 180° about its score line hinges when said flaps are overlapped, and the other of said handle elements complementally seated thereon; and said complementally seated surfaces of said handle elements being secured together to form an integral handle on said top wall pivotable about said score line hinges from a substantially flat position on said top wall to a substantially upright position relative thereto so that said carton may be supported by said handle.

2. The carton of claim 1 wherein said tape is on the other surface of said flaps.

3. The carton of claim 1 wherein said tape is on the inner surface of said flaps.

4. The carton of claim 1 wherein said flaps are formed from two-ply paperboard and said tape is sandwiched between said plies.

5. The carton of claim 1 wherein said tape is of the pressure-sensitive type.

6. The carton of claim 1 wherein said tape is of a mesh construction.

* * * * *